US006800102B2

(12) United States Patent
Goldblatt et al.

(10) Patent No.: US 6,800,102 B2
(45) Date of Patent: Oct. 5, 2004

(54) EMERGENCY FUEL

(75) Inventors: Irwin L. Goldblatt, Edison, NJ (US); Richard Tittel, Jamesburg, NJ (US)

(73) Assignee: Castrol Limited, Wiltshire (GB)

( * ) Notice: Subject to any disclaimer, the term of this patent is extended or adjusted under 35 U.S.C. 154(b) by 0 days.

(21) Appl. No.: 10/396,403

(22) Filed: Mar. 26, 2003

(65) Prior Publication Data

US 2003/0159335 A1 Aug. 28, 2003

Related U.S. Application Data

(62) Division of application No. 09/624,387, filed on Jul. 27, 2000, now Pat. No. 6,558,439.
(60) Provisional application No. 60/145,943, filed on Jul. 28, 1999.

(51) Int. Cl.[7] ..... C10L 1/18; C10L 1/22
(52) U.S. Cl. ..... 44/328; 44/384; 44/436; 585/14
(58) Field of Search ..... 44/328, 384, 436; 585/14

(56) References Cited

U.S. PATENT DOCUMENTS

| | | | | |
|---|---|---|---|---|
| 2,321,280 A | | 6/1943 | Brown | |
| 2,582,192 A | | 1/1952 | Denison, Jr. | |
| 4,357,146 A | | 11/1982 | Heeren | |
| 4,708,720 A | | 11/1987 | Grangette et al. | |
| 4,990,713 A | | 2/1991 | Le et al. | |
| 5,015,356 A | | 5/1991 | Talbert | |
| 5,312,542 A | | 5/1994 | Talbert | |
| 5,407,453 A | | 4/1995 | Pierce-Ruhland et al. | |
| 5,419,849 A | | 5/1995 | Fields et al. | |
| 5,575,822 A | | 11/1996 | Wilkins, Jr. | |
| 5,628,805 A | | 5/1997 | Lif et al. | |
| 5,681,358 A | | 10/1997 | Spencer et al. | |
| 5,853,433 A | | 12/1998 | Spencer et al. | |
| 5,925,196 A | | 7/1999 | Bevilacqua, Jr. et al. | |
| 5,938,799 A | | 8/1999 | Spencer et al. | |
| 6,096,103 A | | 8/2000 | Hubbard et al. | |
| 6,110,237 A | | 8/2000 | Spencer et al. | |
| 6,113,660 A | * | 9/2000 | Hubbard et al. | 44/300 |
| 6,558,439 B1 | * | 5/2003 | Goldblatt et al. | 44/328 |

FOREIGN PATENT DOCUMENTS

| | | |
|---|---|---|
| GB | 606212 | 8/1948 |
| GB | 2298430 | 9/1996 |

OTHER PUBLICATIONS

Technical Manual TM 10–7200–200–13, Department of the Army (Jan. 30, 1989).

* cited by examiner

*Primary Examiner*—Cephia D. Toomer
(74) *Attorney, Agent, or Firm*—Nixon & Vanderhye P.C.

(57) ABSTRACT

An emergency fuel for an internal combustion engine comprises a hydrocarbon solvent having a flash point of at least 100° F. (such as about 65–75% paraffins and about 25–35% naphthenes, or about 75–85% paraffins and about 15–25% of C7 or higher alcohols, or an aromatic solvent, or an naphthalene-depleted aromatic solvent) and a cold starting additive. The cold starting additive may be provided in an amount of less than 5,000 ppm, preferably between about 1 ppm and 150 ppm. The cold starting additive is preferably selected from peroxides, azo compounds, cyano compounds, cetane improvers, or combinations of these compounds. When the emergency fuel is added to a cold engine, including one substantially at room temperature, the engine may be easily started.

46 Claims, No Drawings

EMERGENCY FUEL

CROSS REFERENCE TO RELATED APPLICATION

This application is a division of application Ser. No. 09/624,387, filed Jul. 27, 2000, now U.S. Pat. No. 6,558,439 based on U.S. Provisional Application No. 60/145,943, filed Jul. 28, 1999, the entire content of which is hereby, incorporated by reference in this application.

BACKGROUND AND SUMMARY OF THE INVENTION

The present invention concerns an emergency fuel for a vehicle, i.e. a fuel that can be used when a vehicle is low on fuel or runs out of fuel. The emergency fuel is safe to store until it is required in an emergency. The emergency fuel is capable of starting a cold engine.

U.S. Pat. No. 5,681,358 discloses an emergency fuel comprising mineral spirits having a flash point of at least 100° F. and a boiling point of 320–400° F. The mineral spirits may be a mineral spirit or a mixture of n-butanol and isomers of amyl alcohol, 1-pentanol, or a mixture of 0–100% mineral spirit with 0–100% of an oxygenated solvent. The preferred flash point is in the range of 104–110° F. The emergency fuel is only capable of starting a warmed up motor. The '358 patent states that if the motor is cold then a 'starter fluid', such as a butane spray in the carburetor, may help start the motor. In all of the examples, the emergency fuel failed to start a cold motor.

One goal of the present invention is to provide an emergency fuel that is capable of starting a cold motor. The invention also seeks to provide an emergency fuel that has a relatively high flash point (in excess of 140° F.) and a relatively high distillation range (approaching 370° F. to 400° F.).

DETAILED DESCRIPTION

In accordance with one aspect of the present invention there is provided an emergency fuel for an internal combustion engine comprising a hydrocarbon solvent having a flash point of at least 100° F. and a cold starting additive.

In accordance with another aspect of the present invention there is also provided a method of starting a cold engine with an emergency fuel comprising a hydrocarbon solvent having a flash point of at least 100° F., the method comprising the steps of adding a cold starting additive to the emergency fuel, and supplying the emergency fuel to a cold engine (e.g. substantially at ambient temperature), and starting the engine.

In accordance with another aspect of the present invention there is also provided use of a cold starting additive to start a cold engine with an emergency fuel comprising a hydrocarbon solvent having a flash point of at least 100° F.

In accordance with yet another aspect of the present invention there is also provided an additive system for an emergency fuel, the additive system comprising a cold starting additive.

The cold starting additive is preferably selected from the group consisting essentially of: peroxides, azo compounds, cyano compounds, cetane improvers, and combinations thereof.

The peroxide is preferably di-t-butyl peroxide. The cetane improver is preferably selected from nitrates, nitrites, and nitro and nitroso compounds. The cold starting additive is preferably a combination of at least two additives selected from the group consisting essentially of: peroxides, azo compounds, cyano compounds, and cetane improvers.

The cold starting additive is preferably present in an amount less than 5,000 ppm, more preferably less than 1,000 ppm, even more preferably less than 150 ppm, and most preferably between about 1 ppm and 125 ppm.

The hydrocarbon solvent preferably comprises:

(a) from about 65–75%, preferably about 70%, of paraffins, and from about 25–35%, preferably about 30%, of naphthenes;

(b) from about 75–85%, preferably about 80%, of paraffins, and from about 15–25%, preferably about 20%, of 07 or higher alcohols;

(c) an aromatic solvent (of conventional composition);

(d) a naphthalene-depleted aromatic solvent; or (e) combinations of (a)–(d).

The hydrocarbon solvent preferably has a flash point of at least 140° F., more preferably at least about 150° F.

The invention will now be described, by way of example, with reference to the following:

EXAMPLE

An emergency fuel was prepared comprising a blend of a high boiling isoparaffinic hydrocarbon stock having a flash point of >144° F. and about 100 ppm of di-t-butyl peroxide ("DTBP"). The blend was thoroughly mixed and then introduced into a gasoline tank of a test vehicle. The emergency fuel was tested using a 1997 Buick Riviera having a 3.81 V6 SFI engine. The vehicle was operated until it ran out of fuel. Any fuel in the gasoline lines leading to the gasoline tank was drained away. Approximately one gallon of the emergency fuel was introduced into the gas tank. The ambient temperature was recorded. The vehicle was started while it was still warm. The vehicle was operated on the open road. It was then parked and allowed to cool for one hour, at which time a restart was attempted. An attempt at starting the engine was also made after an additional hour of cool-down. The same test was also carried out for comparative purposes using: a commercial product sold under U.S. Pat. No. 5,681,358; normal paraffin having a flash point of >144° F.; and isoparaffin having a flash point of >144° F. The results are shown below.

| Product | Warm Start | After 1 Hour Cool-Down (no. of cranks) | After 2 Hours Cool-Down (no. of cranks) | Ambient Temperature |
|---|---|---|---|---|
| Commercial product of US-A-5,681,358, sold as SPARE TANK ™ Emergency Fuel, (Flash Point >105° F.) | Yes | 7 | 22 | 54° F. |
| Normal paraffin (Flash Point >144 ° F.) | Yes, with severe knock | 6 | 80 | 52° F. |
| Isoparaffin (Flash Point >144° F.) | Yes | 11 | 84 | 36° F. |

-continued

| Product | Warm Start | After 1 Hour Cool-Down (no. of cranks) | After 2 Hours Cool-Down (no. of cranks) | Ambient Temperature |
|---|---|---|---|---|
| Isoparaffin + 100 ppm DTBP (Flash Point >144° F.) | Yes | 3 | 9 | 49° F. |

Thus the product according to the invention (the last listed product) had significantly-improved cold starting ability compared to the other products tested.

The invention also specifically includes all narrow ranges within a broad range (e.g. 1–125 ppm specifically includes 2–124, 29–125, 50–60, and all other narrow ranges within the broad range).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of starting a cold engine with an emergency fuel comprising a hydrocarbon solvent having a flash point of at least 100° F., the method comprising the steps of:

(i) adding to the emergency fuel, a cold starting additive the group consisting essentially of peroxides, azo compounds, cyano compounds, cetane improvers and combinations thereof, (ii) supplying the emergency fuel to a cold engine, and (iii) starting the engine.

2. The method as claimed in claim 1, wherein the peroxide is di-t-butyl peroxide.

3. The method as claimed in claim 1, wherein the cetane improver is selected from nitrates, nitrites, and nitro and nitroso compounds.

4. The method as claimed in claim 1, wherein the cold starting additive is a combination of at least two additives selected from the following list: peroxides, azo compounds, cyano compounds and cetane improvers.

5. The method as claimed in claimed 4, wherein the cetane improver is selected from nitrates, nitrites, and nitro and nitroso compounds.

6. The method as claimed in claim 1, wherein the cold starting additive is present in the emergency fuel in an amount of less than 5,000 ppm.

7. The method as claimed in claim 1, wherein the cold starting additive is present in the emergency fuel in an amount of less than 1,000 ppm.

8. The method as claimed in claim 1, wherein the cold starting additive is present in the emergency fuel in an amount of less than 150 ppm.

9. The method as claimed in claim 1, wherein the cold starting additive is present in the emergency fuel in an amount of between 1 ppm and 150 ppm.

10. The method as claimed in claim 2, wherein the cold starting additive is present in the emergency fuel in an amount of less than 5,000 ppm.

11. The method as claimed in claim 2, wherein the cold starting additive is present in the emergency fuel in an amount of between 1 ppm and 150 ppm.

12. The method as claimed in claim 3, wherein the cold starting additive is present in the emergency fuel in an amount of less than 5,000 ppm.

13. The method as claimed in claim 3, wherein the cold starting additive is present in the emergency fuel in an amount of between 1 ppm and 150 ppm.

14. The method as claimed in claim 4, wherein the cold starting additive is present in the emergency fuel in an amount of less than 5,000 ppm.

15. The method as claimed in claim 4, wherein the cold starting additive is present in the emergency fuel in an amount of between 1 ppm and 150 ppm.

16. The method as claimed in claim 1, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

17. The method as claimed in claim 2, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

18. The method as claimed in claim 3, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

19. The method as claimed in claim 4, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

20. The method as claimed in claim 6, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

21. The method as claimed in claim 7, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

22. The method as claimed in claim 8, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

23. The method as claimed in claim 9, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

24. The method as claimed in claim 10, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

25. The method as claimed in claim 11, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

26. The method as claimed in claim 12, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

27. The method as claimed in claim 13, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

28. The method as claimed in claim 14, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

29. The method as claimed in claim 15, wherein the hydrocarbon solvent is selected from the group consisting essentially of:

(a) from about 65–75% of paraffins and from about 25–35% of naphthenes;

(b) from about 75–85% of paraffins and from about 15–25% of C7 or higher alcohols;

(c) an aromatic solvent;

(d) a naphthalene-depleted aromatic solvent; and (e) combination of (a)–(d).

30. The method as claimed in claim 16, wherein the hydrocarbon solvent is selected from the group consisting essentially of:

(a) around 70% of paraffins and around 30% of naphthenes; and (b) around 80% of paraffins and around 20% of C7 or higher alcohols.

31. The method as claimed in claim 20, wherein the hydrocarbon solvent is selected from the group consisting essentially of:

(a) around 70% of paraffins and around 30% of naphthenes; and (b) around 80% of paraffins and around 20% of C7 or higher alcohols.

32. The method as claimed in claim 23, wherein the hydrocarbon solvent is selected from the group consisting essentially of:

(a) around 70% of paraffins and around 30% of naphthenes; and (b) around 80% of paraffins and around 20% of C7 or higher alcohols.

33. The method as claimed in claim 1, wherein the hydrocarbon solvent has a flash point of at least 140° F.

34. The method as claimed in claim 2, wherein the hydrocarbon solvent has a flash point of at least 140° F.

35. The method as claimed in claim 3, wherein the hydrocarbon solvent has a flash point of at least 140° F.

36. The method as claimed in claim 4, wherein the hydrocarbon solvent has a flash point of at least 140° F.

37. The method as claimed in claim 6, wherein the hydrocarbon solvent has a flash point of at least 140° F.

38. The method as claimed in claim 16, wherein the hydrocarbon solvent has a flash point of at least 140° F.

39. The method as claimed in claim 20, wherein the hydrocarbon solvent has a flash point of at least 140° F.

40. The method as claimed in claim 33, wherein the hydrocarbon solvent has a flash point of at least 150° F.

41. The method as claimed in claim 34, wherein the hydrocarbon solvent has a flash point of at least 150° F.

42. The method as claimed in claim 35, wherein the hydrocarbon solvent has a flash point of at least 150° F.

43. The method as claimed in claim 36, wherein the hydrocarbon solvent has a flash point of at least 150° F.

44. The method as claimed in claim 37, wherein the hydrocarbon solvent has a flash point of at least 150° F.

45. The method as claimed in claim 38, wherein the hydrocarbon solvent has a flash point of at least 150° F.

46. The method as claimed in claim 39, wherein the hydrocarbon solvent has a flash point of at least 150° F.

* * * * *

UNITED STATES PATENT AND TRADEMARK OFFICE

CERTIFICATE OF CORRECTION

PATENT NO. : 6,800,102 B2
DATED : October 5, 2004
INVENTOR(S) : Goldblatt et al.

It is certified that error appears in the above-identified patent and that said Letters Patent is hereby corrected as shown below:

Column 3,
Lines 31-34, should read as follows:
-- (i) adding to the emergency fuel, a cold starting additive selected from the group consisting essentially of peroxides, azo compounds, cyano compounds, cetane improvers and combinations thereof, --

Signed and Sealed this

Nineteenth Day of April, 2005

JON W. DUDAS
*Director of the United States Patent and Trademark Office*